US008191725B2

(12) United States Patent
Vargo

(10) Patent No.: US 8,191,725 B2
(45) Date of Patent: Jun. 5, 2012

(54) PARTY TRASH PAIL

(76) Inventor: Patricia R. Vargo, Marlboro, NJ (US)

( * ) Notice: Subject to any disclaimer, the term of this patent is extended or adjusted under 35 U.S.C. 154(b) by 363 days.

(21) Appl. No.: 12/455,596

(22) Filed: Jun. 5, 2009

(65) Prior Publication Data

US 2009/0255935 A1 Oct. 15, 2009

Related U.S. Application Data

(63) Continuation-in-part of application No. 11/342,066, filed on Jan. 30, 2006, now abandoned.

(51) Int. Cl.
*B65D 25/14* (2006.01)
*G09F 3/04* (2006.01)

(52) U.S. Cl. ..... 220/495.11; 40/308

(58) Field of Classification Search ..... 220/495.11, 220/495.08, 495.06, 495.01, 908.1, 908; 206/577, 223, 216; D34/1; 40/306, 308, 40/299.01; 383/11; D5/10, 9, 22, 21; *B65D 25/14, B65D 35/14; G09F 3/10, 3/08, 3/06, 3/04*
See application file for complete search history.

(56) References Cited

U.S. PATENT DOCUMENTS

| | | | | |
|---|---|---|---|---|
| 3,148,799 | A * | 9/1964 | Meroney | 220/495.11 |
| 3,803,738 | A * | 4/1974 | Weiss | 40/306 |
| 4,364,490 | A * | 12/1982 | Lang et al. | 220/495.07 |
| 4,747,701 | A * | 5/1988 | Perkins | 383/33 |
| 4,976,371 | A * | 12/1990 | Wise et al. | 220/315 |
| 5,616,383 | A * | 4/1997 | Weder | 428/35.7 |
| 5,740,939 | A * | 4/1998 | Muldner et al. | 220/495.11 |
| 6,139,185 | A * | 10/2000 | Hamilton et al. | 383/11 |
| 6,505,425 | B1 * | 1/2003 | Gilbert | 40/306 |
| 6,728,996 | B2 * | 5/2004 | Roscow | 24/306 |
| 7,121,027 | B1 * | 10/2006 | Sadallah | 40/567 |
| 2002/0128081 | A1 * | 9/2002 | Clarke et al. | 472/81 |
| 2003/0074770 | A1 * | 4/2003 | Roscow | 24/306 |
| 2004/0182866 | A1 * | 9/2004 | Carrillo | 220/495.06 |

* cited by examiner

*Primary Examiner* — Mickey Yu
*Assistant Examiner* — Robert J Hicks
(74) *Attorney, Agent, or Firm* — Charles I. Brodsky

(57) ABSTRACT

A party trash pail including a container of predetermined volume, a plasticized liner removably insertable therein of a configuration to expand towards filling the container volume when laden with trash, yet with an upper dimension to overlap a defining outer rim of the container, and a header bearing against an outer surface of the liner to retain it in place within the container.

5 Claims, 3 Drawing Sheets

PARTY TRASH PAIL

CROSS-REFERENCE TO RELATED APPLICATIONS

This Application is a Continuation-in-Part of application Ser. No. 11/342,066, filed Jan. 30, 2006 now abandoned.

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

NOT APPLICABLE

BACKGROUND OF THE INVENTION

1. Field of the Invention

This invention relates to trash pails, in general, and to one which can be maintained hygienically clean for everyday use and for special occasions, in particular.

2. Description of the Related Art

As will be appreciated, most trash containers for everyday home use both indoors and outdoors are fabricated of plastic, usually drab green or grey in color. Commonly of 20 to 30 gallon capacity, they typically receive disposable trash bags as liners which, when filled, are typically tied off and then carried to the street for collection.

As will also be appreciated, the trash bags employed do not work as well as desired when used at large party occasions. Sometimes, for example, the trash bag is of a capacity less than that of the container—and slips down into the container as the bag becomes weighted with more and more added refuse. Sometimes, where the trash bag is of a larger capacity than the container, its open edges draped over the container's rim in an attempt to hold the bag in place unfortunately become dislodged because of the weight of the refuse, paper plates, paper cups, plastic utensils, etc. discarded therein; the combined weight then pulls the entire bag into the container.

As will be understood, with either of these happenings, the deposited trash overflowing the bag then tends to bear against, and contact, the inside surfaces of the container. Although the container should be cleaned for purposes of hygiene once the filled bag is removed, that usually isn't done. As will also be understood, when the container's covering lid is not fitted in place, the crumbled and disheveled bag inside can be seen and presents an unsightly appearance. As will be further understood, just having a drab green or grey plastic container at a kitchen area indoors, or alongside a barbecue grill in the outdoors, does very little to enliven or enhance the festivities of an occasion or event when a party or like get-together is going on.

Analysis of these situations has led to a realization that even if one were to try to assiduously match the capacity of the trash bag to the capacity of the trash container, these type of offensive conditions would continue to persist—and because the trash bags are composed of a pair of overlapping liner sheets fused together at their side and bottom edges. Testing has shown, in particular, that such joinings together limit their fillings and prevent the bag, once filled, from taking on the shape of the tapering-sided trash container in which the bag is placed.

SUMMARY OF THE INVENTION

As will become clear hereinafter, the present invention takes as its starting point a trash container which is cylindrical, or substantially cylindrical in configuration preferably with a covering lid. The invention then proceeds with a trash bag of capacity slightly larger than that of the container—but configured and designed so as to take on the comparable shape of the inside of the container once the trash bag is opened. By being slightly larger than the container itself, the bag of the invention is thus allowed to overlap the rim of the container so that when folded over the rim, in accordance with a first embodiment of the invention, an elastic band can be utilized as a "header" near the top of the container. This allows the "header" to rest against the folded over bag in retaining the bag in place as it is being weighted down with party refuse. In accordance with this embodiment of the invention, furthermore, the container is fabricated of a white or black plastic so as to allow for its being easily decorated according to any ongoing event—supplemented, if desired, by streamers or other frills hanging down from the encircling elastic band.

By matching the trash bag to the trash container in this manner, not only will the bag fill the container according to its volume, and being held there by the surrounding band in a decorous manner, but the bag, once released from being held in place and lifted from the container, allows the inside surface of the container to remain substantially untouched by any refuse. Only a minimal amount of cleaning would then be required after its use. As will be seen, in this embodiment, the trash bag is composed of a plasticized liner of at least a 20 gallon volume.

In accordance with a second embodiment of the invention, one component of two component hook and loop fastener strips may be employed, either running circumferentially about the container or axially along it to releasably affix to headers configured to be illustrative of, or to depict, a party or holiday occasion. By constructing the "header" to itself employ the second component of this hook and loop fastener strip on an underside, the "header" with its decorative display will be seen to overlap that portion of the liner folded over the container rim in further holding the liner in place within the container. This allows an interchangability of such "headers" so as to reflect the occasion to which the party trash pail container of the invention is used.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE INVENTION

Figure 1:
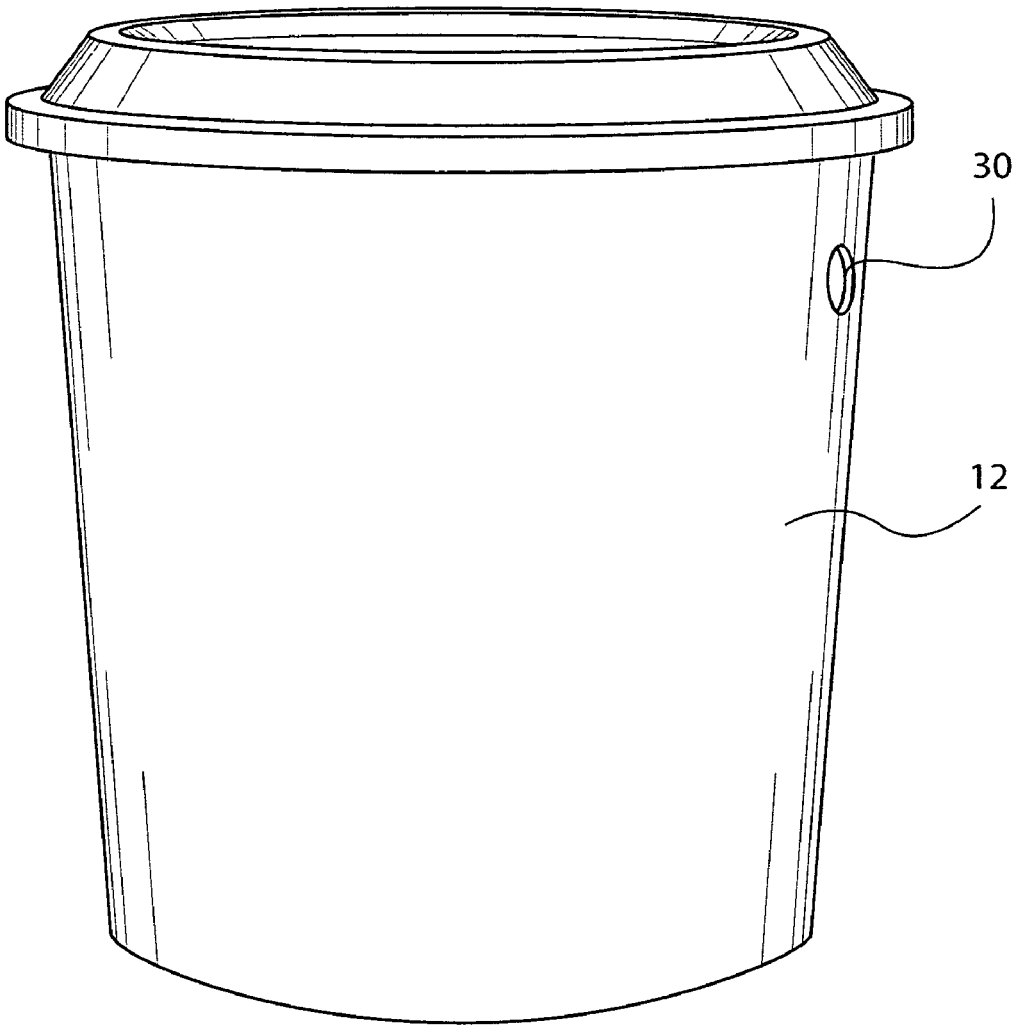
FIGS. 1 and 2 respectively show the trash container and trash bag of the invention as separated, with the bag ready for insertion into the container as a liner.
Figure 2:
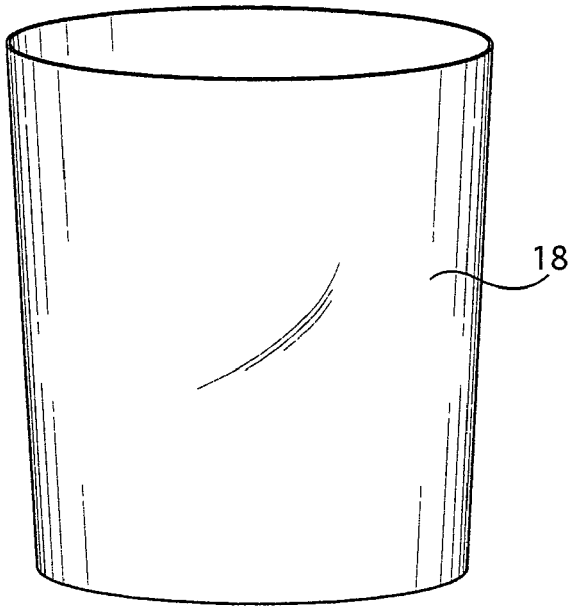
Figure 3:
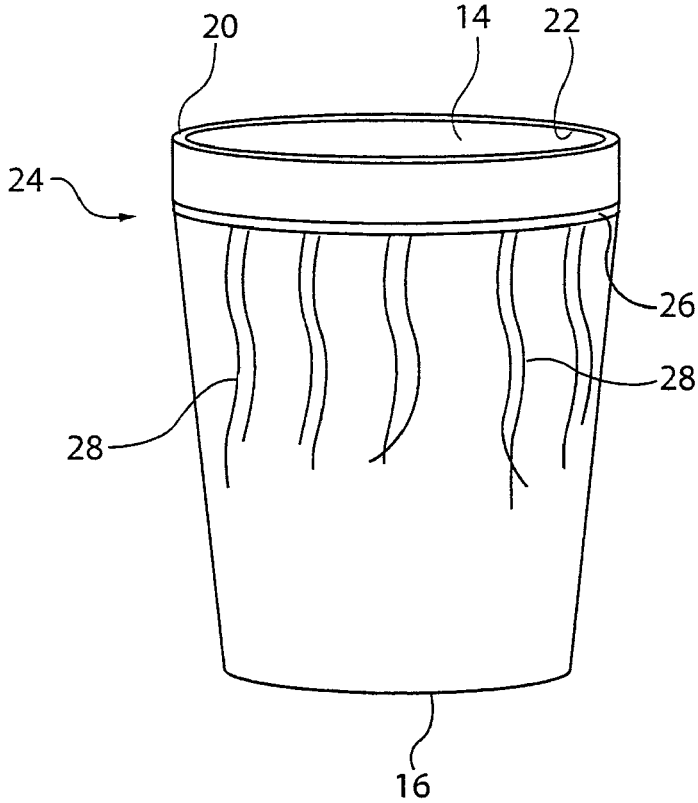
FIG. 3 is an illustration of the trash container of the invention with the trash bag in place as a liner.

In the Drawings, the trash pail of the invention 10 includes one of a cylindrical and substantially cylindrical container of predetermined volume 12. For the first embodiment of the invention of FIGS. 2 and 3, the container 12 includes an open top 14 of outer diameter greater than the diameter of an included closed bottom 16. An open-top, closed-bottom plasticized liner 18 is removably insertable into the container 12, and selected of a configuration to expand towards filling the container volume when laden with trash added through its own open-top. As more clearly shown in FIG. 3, the liner 18 is of an upper dimension 20 to overlap a defining outer rim 22 of the container 12. In accordance with this first embodiment of the invention, a header 24 (FIG. 3) bears against an outer surface of the plasticized liner 18 at a location below the overlapping portion of the liner, and below the outer rim 22, in retaining the liner 18 in place within the container 12.

In this construction of the party trash pail of the invention, such header 24 includes an elastic band 26 from which a plurality of streamers 28 hang downwardly along an outside surface of the container 12 for purposes of decoration.

As will be appreciated, the inclusion of the streamers 28 allow the party pail of this embodiment to take on a decorative appearance—which is also fostered by fabricating the container 12 of white or black plastic, rather than of the drab green or grey which previously characterizes prior container designs. As will also be apparent, configuring the container 12 with an open top diameter greater than that of the closed bottom facilitates the removal of the filled liner 18 from the container. An aperture 30 of the container 12 is provided for receiving a nail, hook or other fastener extending from a wall surface (as in a garage). This allows the party pail of this embodiment to be hung away for storage when not needed, or is no longer intended for use.

With a plasticized liner 18 fillable to a size of at least 20 gallon volume in this manner (and preferably to one of 28-32 gallon volume), not only will the party pail of the invention present an attractive appearance—but one which can be set up as an "events can" for special occasions through the addition of the streamers 28, as well as the addition of any decorations suitable to the "occasion". These also can be inserted beneath and held in place against the container by the elastic band 26. Preventing the liner from falling into the container continues to keep the inside of the container hygienically clean besides allowing the container to be set up for the special occasion use. As will be seen, this allows the present invention to serve as a "party trash pail", instead of just as a garbage pail which sits in a home or at a backyard, with a liner which continually collapses into the container as it becomes filled by use.

Figure 4:
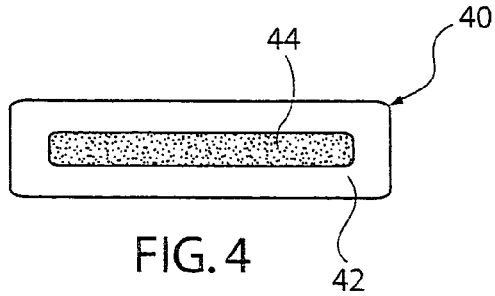
FIG. 4 is a bottom view of the "header" of the second embodiment of the invention with its hook and loop fastener strip component.
Figure 5:
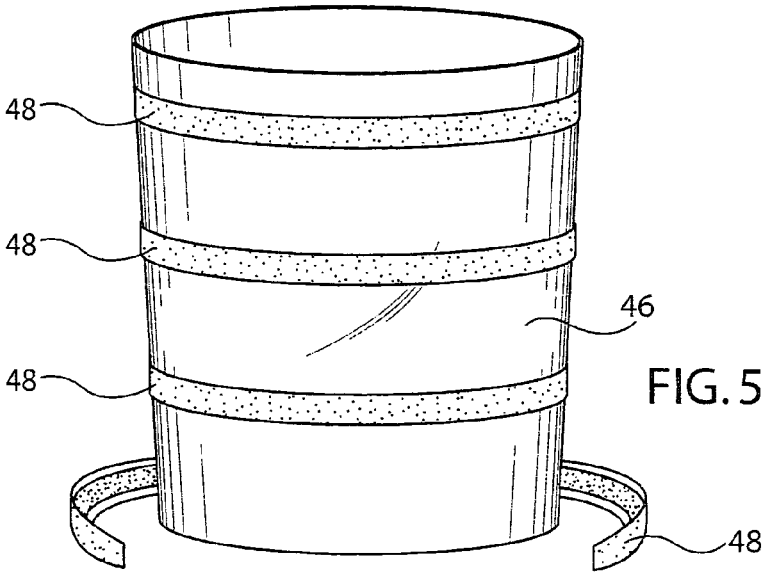
FIGS. 5 and 6 depict the container of the second embodiment with its own hook and loop fastener strip component running circumferentially about the container and axially along it, respectively, so as to releasably affix with the underside of the "header" of FIG. 4.
Figure 6:
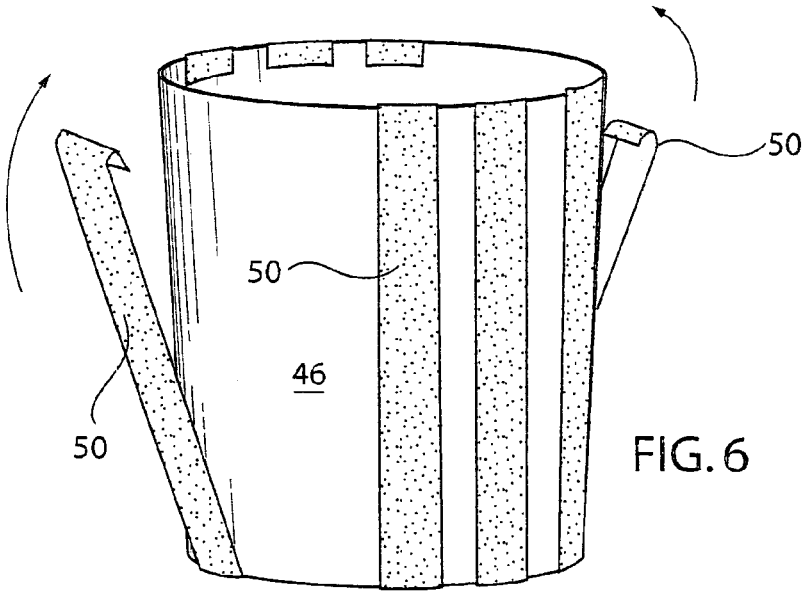

In the embodiments of the invention shown in FIGS. 5 and 6, a "header" of the type whose underside is shown in FIG. 4 is utilized. As will be understood, the underside 42 includes one component 44 of a two-component hook and loop fastener strip —while on its opposing top side, the header 40 is decorated illustrative of a party or holiday occasion when the party pail of the invention is to be used. Such decoration on the top side can be as simple as a white and silver coloration for a bridal wedding party, a blue or pink colored display for use at a baby-welcoming home party, or as red-white-blue coloration for the Memorial, July 4th or Labor Day observances in the United States. Alternatively, the top side of the header 40 could be decorated instead with scenes illustrative of Thanksgiving, Christmas or Halloween type holidays when the party pail is to be used, prior to its being stored after the occasion has passed.

FIG. 5 shows a container 46 constructed in accordance with this embodiment of the invention with the second component 48 of the two-component hook and loop fastener strip running circumferentially about the outer surface of the container. The decorative header 40 is placed over the folded portion of the liner an appropriate distance to extend to and releasably affix with one of the components 48 so as to display the decoration on its top surface, while serving to hold the liner in place within the container. FIG. 6 shows the second component of the hook and loop fastener strip by reference numeral 50, running axially along the container so as to again releasably affix to the first component 44 of the hook and loop fastener strip when the header 40 is once again folded over atop the overlap of the liner at the outer rim of the container. In each version of FIGS. 5 and 6, once the container is filled, or after the party or holiday occasion has passed, the "header" can be released from the container and the liner then lifted out for typical disposal. By employing multiple strip component 48 and 50 in the illustrated embodiments, "headers" of varying widths could be employed.

While there have been described what are considered to be preferred embodiments of the present invention, it will be readily appreciated by those skilled in the art that modifications can be made without departing from the scope of the teachings herein. For at least such reasons, therefore, resort should be had to the claims appended hereto for a true understanding of the scope of the invention.

I claim:

1. A party trash pail package comprising:

one of a cylindrical and substantially cylindrical container of a first predetermined volume, having an upper outer rim and a first component of a two-component hook and loop fastener on an outside surface of said container;

an open-top, closed-bottom plasticized liner removably insertable into said container, said liner being configured to expand towards filling said container volume when laden with trash added through said open-top and;

wherein said liner is of a second predetermined volume fillable to a capacity only slightly larger than said first predetermined volume of said container so as to be thereby held against an inside surface of said container once inserted into said container; and a plurality of differentiating, removable headers incorporating the second component of said two-component hook and loop fastener on an underside thereof for releasably affixing to said first component in holding the liner in place within the container;

with each differentiating removable header having a top surface illustrative of a given holiday or party occasion to be celebrated, with a plurality of downwardly hanging streamers decorated consistent with the occasion being celebrated according to a selected interchangeable header, to be then hung along the outside surface of the container;

and wherein the given holiday occasion includes the holidays of Thanksgiving, Christmas and Halloween, and wherein the given party occasions includes birthdays, bridal wedding parties, baby welcoming home parties and wedding anniversaries.

2. The party trash pail of claim 1, also including means on said container for hanging away said container for storage when not in use.

3. The party trash pail of claim 2, wherein said plasticized liner is fillable to a capacity of at least 20 gallons volume; and wherein said container includes an open top of a diameter greater than the diameter of an included closed bottom.

4. The party trash pail of claim 3, wherein said first component of said two-component hook and loop fastener runs circumferentially about the upper outer surface of said container.

5. The party trash pail of claim 3, wherein said first component of said two-component hook and loop fastener runs axially along the upper outer surface of said container.

* * * * *